US005323091A

United States Patent [19]

Morris

[11] Patent Number: 5,323,091

[45] Date of Patent: Jun. 21, 1994

[54] STARTING SOURCE FOR ARC DISCHARGE LAMPS

[75] Inventor: James C. Morris, Wakefield, Mass.

[73] Assignee: GTE Products Corporation, Danvers, Mass.

[21] Appl. No.: 971,500

[22] Filed: Nov. 4, 1992

[51] Int. Cl.[5] ..... H07J 11/04

[52] U.S. Cl. ..... 315/344; 315/267; 315/248; 315/634; 315/601

[58] Field of Search ..... 315/267, 160, 158, 71, 315/73, 248, 344; 313/634, 306, 581, 588, 589, 601, 591, 594

[56] References Cited

U.S. PATENT DOCUMENTS

| | | | |
|---|---|---|---|
| 3,226,597 | 9/1963 | Green | 315/60 |
| 3,900,761 | 8/1975 | Freese et al. | 315/248 |
| 4,041,352 | 8/1977 | McNeill et al. | 315/248 |
| 4,053,814 | 10/1977 | Regan et al. | 315/248 |
| 4,097,777 | 6/1978 | Bacharowski | 315/60 |
| 4,325,004 | 4/1982 | Proud et al. | 315/45 |
| 4,355,261 | 10/1982 | Cohen et al. | 315/47 |
| 4,721,888 | 1/1988 | Proud | 315/60 |
| 4,818,915 | 4/1989 | Zaslavsky et al. | 315/60 |
| 4,891,554 | 1/1990 | Levand, Jr. et al. | 313/634 |

*Primary Examiner*—James B. Mullins
*Assistant Examiner*—J. Dudek
*Attorney, Agent, or Firm*—Carlo S. Bessone

[57] ABSTRACT

An ultraviolet starting aid is formed in a metal halide arc discharge lamp by forming a cavity in a press seal portion of an arc tube. An electrode is provided in the cavity which either extends external to the press seal, or the electrode may be a portion of molybdenum ribbon used in the press seal.

15 Claims, 3 Drawing Sheets

STARTING SOURCE FOR ARC DISCHARGE LAMPS

BACKGROUND OF THE INVENTION

This invention relates to an ultraviolet radiation starting source for an arc discharge lamp.

High pressure metal halide arc discharge lamps typically comprise an arc tube which encloses an ionizable fill material and two electrodes at opposing ends of the tube. To reduce the time it takes to start the lamp, a starter electrode may be disposed inside the arc tube near one of the main electrodes, as shown in Freese et. al., U.S. Pat. No. 3,900,761. A discharge can be initiated between the starter electrode and one of the main electrodes at a voltage that is much lower than the voltage required to ignite an arc between the two main electrodes. The ultraviolet radiation from this discharge produces photoelectrons which enhance gas breakdown and discharge formation in the arc tube between the two main electrodes.

Zaslavsky et. al., U.S. Pat. No. 4,818,915, issued Apr. 4, 1989, discloses a UV enhancer which is separate from the arc tube. The '915 patent, which is incorporated herein by reference, describes a UV enhancer which typically has a borosilicate glass envelope enclosing an ionizable fill material and a single electrode. The single electrode has a getter which can remove certain gases when the envelope heats and outgasses. When energized, the UV enhancer produces ultraviolet radiation which illuminates the path between the main electrodes within the arc tube, thus decreasing the time for generating a high intensity arc discharge.

The starter electrode approach and the separate UV enhancer each require additional parts and manufacturing steps. The extra parts and steps add to the lamp manufacturing cost.

It is an object of the present invention to provide an improved starting source for an arc discharge lamp.

It is another object of the present invention to provide a starting source which has fewer components than prior art devices.

It is yet another object of the present invention to provide a starting source which is easy to manufacture.

It is still another object of the present invention to provide a starting source which efficiently couples radiation to the interior of the arc tube.

SUMMARY OF THE INVENTION

According to the present invention, these and other objects and advantages are achieved in an arc discharge lamp which comprises a light-transmissive arc tube which includes at least one press seal. A first fill material is contained in an interior of the arc tube for supporting an arc discharge. A means is provided for coupling electrical energy to the interior of the arc tube. A starting source is provided which comprises a sealed cavity in the press seal, a second fill material in the cavity for supporting emission of ultraviolet radiation, and a means for coupling electrical energy to the cavity. The starting source emits ultraviolet radiation which assists in initiation of an arc discharge within the interior of the arc tube.

In preferred embodiments, the means for coupling electrical energy to the cavity comprises a fixture for coupling RF or microwave energy to the cavity. The arc tube assembly can further comprise a getter in the cavity for gettering a gas in the cavity when activated, or a dispenser for providing a material in the cavity which enhances ultraviolet radiation.

In another aspect, the invention features an arc tube assembly which comprises a light-transmissive arc tube with electrodes mounted within an interior of the arc tube, a first fill material contained in the interior of the arc tube for supporting an arc discharge, and press seals at opposite ends of the arc tube. A means is provided for coupling electrical energy to said electrodes. A starting source is provided which comprises a sealed cavity in one of the press seals, a second fill material in the cavity for supporting emission of ultraviolet radiation, and a means for coupling electrical energy to said cavity. The starting source emits ultraviolet radiation which assists in initiation of an arc discharge within the interior of the arc tube.

In preferred embodiments, the means for coupling electrical energy to the electrodes includes a conductive foil in each of the press seals. The means for coupling electrical energy to said cavity comprises a portion of one of the conductive foils that extends into the cavity, and a conductor positioned adjacent to the press seal containing the cavity. The means for coupling electrical energy to the cavity may instead comprise a first conductor connected to one of the conductive foils and extending into the cavity and a second conductor located adjacent to the press seal containing the cavity. The first conductor has a sharp edge to provide breakdown at a lower voltage.

In another preferred embodiment, the means for coupling electrical energy to said cavity comprises an electrode extending into the cavity for external application of electrical energy. The electrode extending into the cavity has a sharp edge.

In still another preferred embodiment, the means for coupling electrical energy to the cavity comprises a portion of the conductive foil extending into the cavity, and a second conductive foil, having an external lead attached thereto, extending into the cavity. In yet another preferred embodiment, the arc tube assembly further comprises a getter located in the cavity for gettering a gas in the cavity, or a dispenser for providing a material which enhances ultraviolet radiation.

By forming a cavity in the press seal and generating ultraviolet radiation within the cavity, a starting source which mainly uses existing components is provided. This starting source requires few, if any, additional components, saves manufacturing steps, and allows an arc discharge lamp to be produced at lower cost than prior art lamps. In addition, light piping action through the press sealed material efficiently couples radiation from the cavity to the arc tube. Radiation transfer is also improved because the cavity in the press seal is much closer to the arc tube than a typical starting source in a separate envelope.

BRIEF DESCRIPTION OF THE DRAWINGS

For a better understanding of the present invention together with other and further objects, advantages, and capabilities thereof, reference is made to the accompanying drawings which are incorporated herein by reference and in which.

DESCRIPTION OF THE PREFERRED EMBODIMENTS

Figure 1:
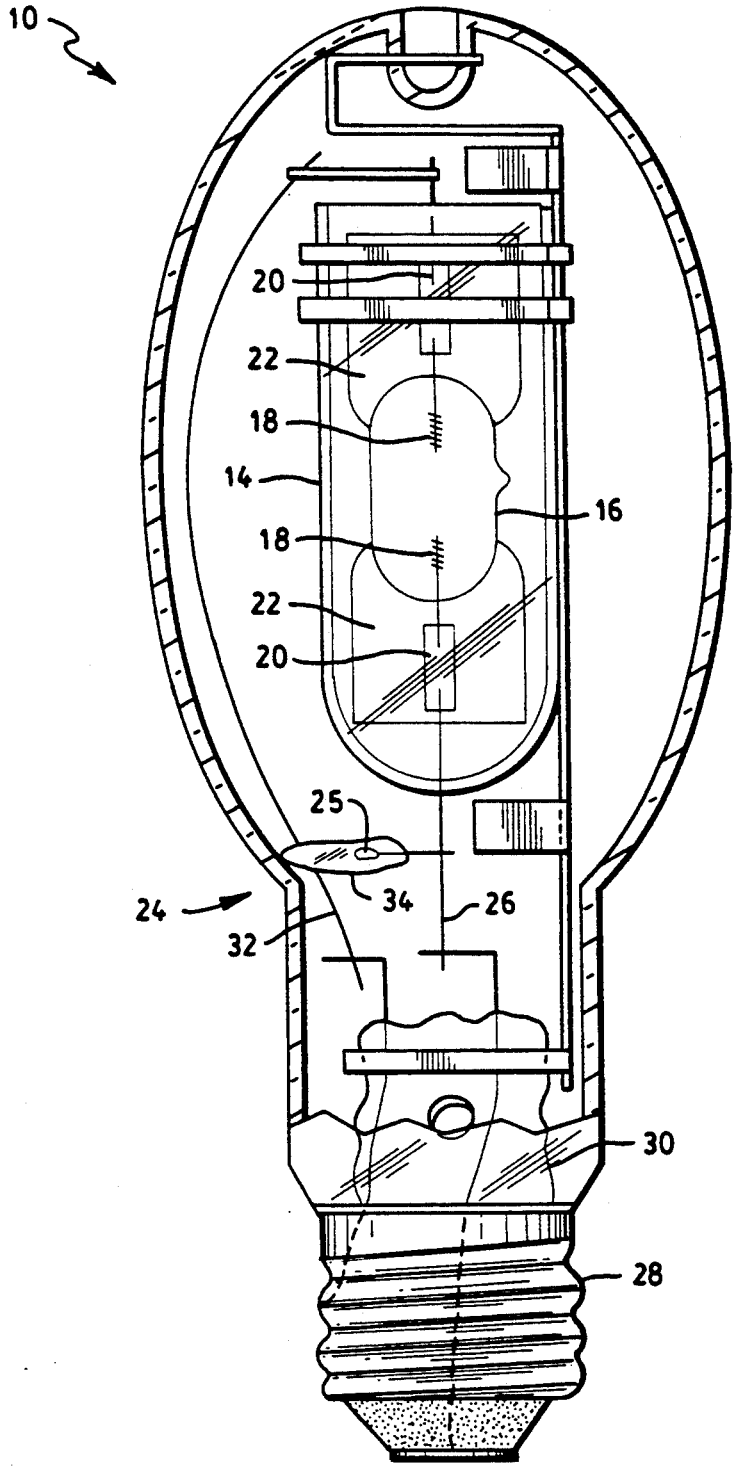
FIG. 1 PRIOR ART
FIG. 1 is a view of prior art metal halide arc discharge lamp.

A prior art metal halide arc discharge lamp 10 is shown in FIG. 1. A sealed envelope 12 encloses a cylindrical quartz sleeve 14. The sleeve 14 surrounds an arc tube 16 which encloses two electrodes 18 located at opposite ends of the arc tube and a fill material, e.g., a combination of mercury, metal halides, and argon. Each electrode is coupled to a molybdenum ribbon 20 which is enclosed within a press seal 22 that hermetically seals the arc tube. Electrical energy is coupled from a lamp base 28 through a lamp stem 30 and leads 32 and 26 to the electrodes 18 in the arc tube 16.

A UV enhancer 24 has a sealed envelope 34 that encloses an electrode 25. The electrode 25 is coupled to the lead 26, and is capacitively coupled to the lead 32, which may include a conductor that is helically wrapped around the envelope 34. A typical UV enhancer is about 4.0 mm in diameter and 15.0 to 20.0 mm in overall length. Other details relating to the prior art UV enhancer 24 are disclosed in the '915 patent identified above.

Figure 2:
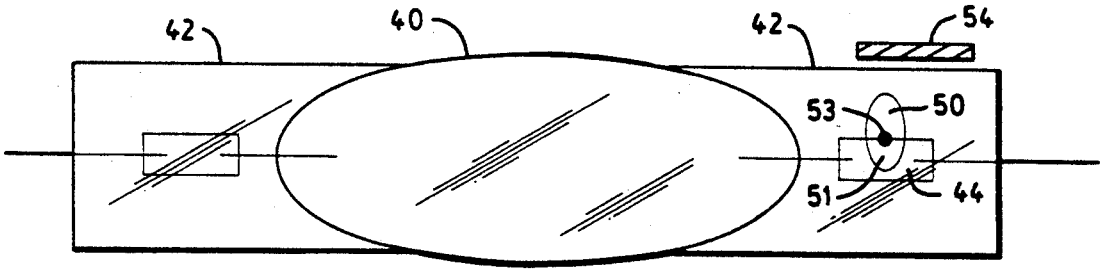
FIGS. 2 and 3 are side view and partial cross-sectional views, respectively, of a first embodiment of the invention.
Figure 3:
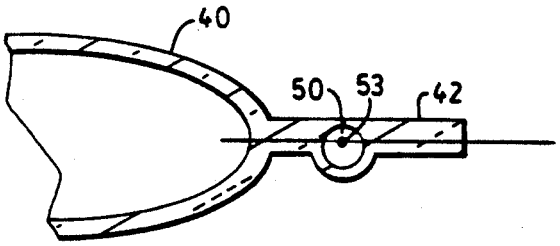

A first embodiment of the invention is shown in FIGS. 2 and 3. A quartz arc tube 40 is sealed by two press seals 42 at opposite ends of the tube. Within each press seal is a molybdenum foil 44. Electrodes 46 located within the arc tube 40 and external leads 48 arc connected to the molybdenum foils 44. A cavity 50 is formed in the press seal 42 so that it encloses a portion 51 of the foil 44. The foil 44 has at least one very sharp edge to provide high electric field concentration and to allow breakdown at lower voltages and higher pressures. The cavity 50 also encloses flush gases, such as nitrogen and argon, which are used in the press sealing process, a technique well known in the art. When the cavity 50 is formed, the flush gases are at a temperature near the melting point of the quartz arc tube 40. When these gases cool, the pressure within cavity 50 decreases to about one third to one-quarter atmosphere. An external ground plane 54 is attached to existing grounded frame parts allowing capacitive coupling between the foil 44 and the ground plane 54.

When the lamp is energized, electric fields are produced within cavity 50 by the voltage between foil 44 and ground plane 54. The electric fields cause ionization of the fill material within cavity 50 and generation of ultraviolet radiation. The ultraviolet radiation promotes formation of an arc between electrodes 46. Thus, the cavity 50, foil portion 51 and ground plane 54 constitute a UV enhancer, or starting source, that is integrally formed (except for ground plane 54) within the press seal 42 of arc tube 40.

The cavity may be formed by drilling a small hole, e.q. 2.0 mm wide, or by forming an indentation, in the face of a press foot (not shown) at a location corresponding to the location where the cavity is to be formed. As flush gases flow through the tube and the tube is heated, the press feet force the end of the quartz tube together, thus driving the flush gases out. Where the indentation or hole is formed in the press foot, the quartz is not forced together and the cavity forms as the tube is press sealed. Cavities are sometimes formed inadvertently in a press seal, but no provision is made for an electrode in the cavity. Such cavities are considered harmless imperfections.

The cavity can be spherical or some other shape, and can vary in size depending on the size of the press seal. Examples of cavities have ranged from 1.0 mm to 10.0 mm in length and from less than 1.0 mm to 5.0 mm in diameter.

The gas pressure in the cavity can be reduced by flushing with a mixture of gases, such as argon and nitrogen, and adding a getter for one of the gases. After the cavity is sealed, the getter can be activated with heat or electrical energy. The getter absorbs a gas, thus reducing the pressure of the gettered gas and the total pressure in the cavity.

Instead of a getter, or in combination with a getter, a dispenser may be added to the cavity. The dispenser is a composition that includes a material to be dispensed, such as mercury, which enhances ultraviolet radiation. The dispenser can also be activated with heat or electrical energy after the cavity is sealed. Either a getter or a dispenser composition can be conveniently added onto a portion 53 of the molybdenum foil 44. Compositions for gettering and dispensing are generally known in the art.

Figure 4:
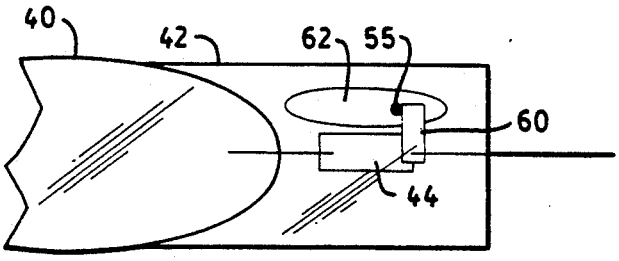
FIGS. 4–8 are side views of additional embodiments of the invention.

Additional embodiments of the invention are shown in FIGS. 4–8. Referring to FIG. 4, if there is concern about the integrity of the seal, a second molybdenum foil 60 can be spot welded to foil 20 and used as a separate electrode. At least a portion of foil 60 extends into a cavity 62 formed in press seal 42. In this case, cavity 62 does not come into contact with the foil 20. A getter or dispenser 55 is provided on to the foil 60 as discussed above.

Figure 5:
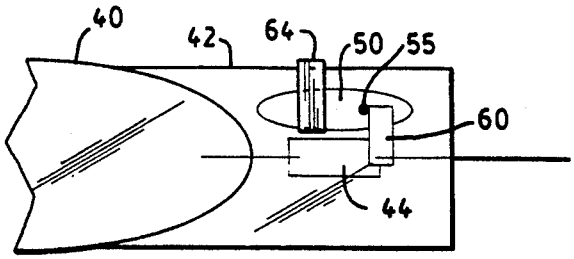

In the embodiment shown in FIG. 5, an external metal ground plane 64 is provided. The ground plane 64 is a U shaped conductor, such as stainless steel, which is attached to the outside of the press seal 42 or mounted close to the press seal.

Figure 6:
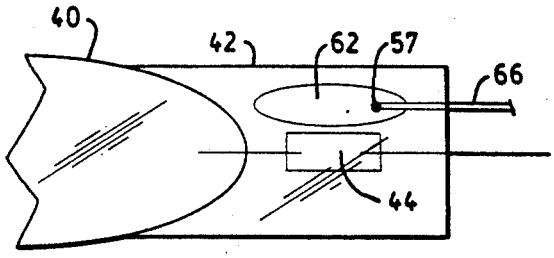

Referring to FIG. 6, if a separate connection to the UV enhancer is desired, an electrode 66 can extend from outside the press seal 42 into the cavity 62, and a getter or dispenser 57 can be provided on the electrode 66.

Figure 7:
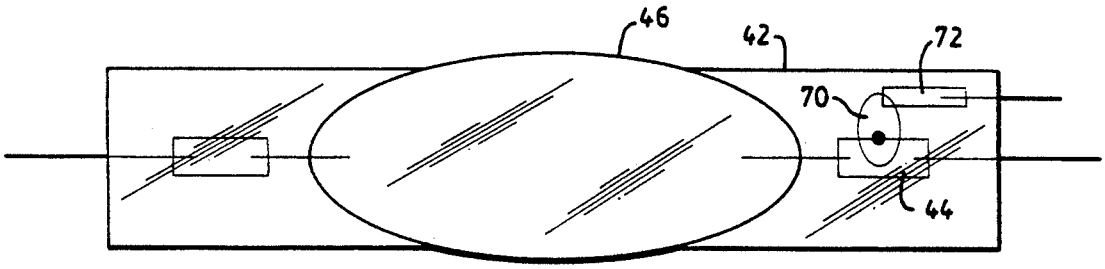

In the embodiment of FIG. 7, a cavity 70 encloses a portion of foil 44 and also a portion of an electrode 72 which extends outside the press seal 42.

For each of the embodiments described in connection with FIGS. 2–7, the lamp is otherwise similar to the lamp described above in connection with FIG. 1.

Figure 8:
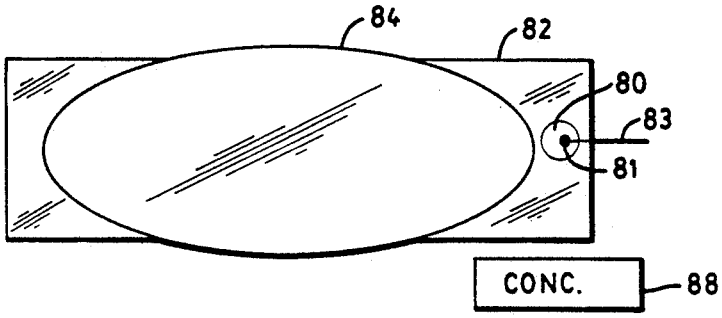

An RF type light source can have a starting source in a press seal. Referring to FIG. 8, a cavity 80 is formed in the press seal 82 of an RF arc tube 84 which encloses no electrodes. In this embodiment, a concentrator 88 enhances the electric field in the region of cavity 80. The concentrator can inductively or capacitively couple a high frequency electric field to the cavity 80. Plates or windings can be used for this purpose. A getter or dispenser 81 can be provided in the cavity 80. The getter or dispenser 81 can be mounted at the end of a rod or wire 83.

While there has been shown and described what is at present considered the preferred embodiments of the present invention, it will be obvious to those skilled in the art that various changes and modifications may be made therein without departing from the scope of the invention as defined by the appended claims.

What is claimed is:

1. An arc tube assembly comprising:

a light transmissive arc tube and a first fill material contained in an interior of said arc tube for supporting an arc discharge, said arc tube including at least one press seal;

means for coupling electrical energy to the interior of said arc tube; and a starting source comprising a sealed cavity in said press seal, a second fill material in said cavity for supporting emission of ultraviolet radiation, and means for coupling electrical energy to said cavity, said starting source emitting ultraviolet radiation which assists in initiation of an arc discharge within the interior of said arc tube.

2. An arc tube assembly as defined in claim 1 wherein said means for coupling electrical energy to said cavity comprises a fixture for coupling RF or microwave energy to said cavity.

3. An arc tube assembly as defined in claim 1 further comprising a dispenser in said cavity for providing a material which enhances ultraviolet radiation when the dispenser is activated.

4. An arc tube assembly as defined in claim 1 further comprising a getter in said cavity for gettering at least one of the gases in the fill material when activated.

5. An arc tube assembly comprising:

a light-transmissive arc tube, electrodes mounted within an interior of said arc tube and a first fill material contained in the interior of said arc tube for supporting an arc discharge, said arc tube including press seals at opposite ends;

means for coupling electrical energy to said electrodes; and a starting source comprising a sealed cavity in one of said press seals, a second fill material in said cavity for supporting emission of ultraviolet radiation and means for coupling electrical energy to said cavity, said starting source emitting ultraviolet radiation which assists in initiation of an arc discharge within the interior of said arc tube.

6. An arc tube assembly as defined in claim 5 wherein said means for coupling electrical energy to said electrodes includes a conductive foil in each of said press seals.

7. An arc tube assembly as defined in claim 6 wherein said means for coupling electrical energy to said cavity comprises a portion of one of said conductive foils that extends into said cavity and a conductor positioned adjacent to the press seal containing said cavity.

8. An arc tube assembly as defined in claim 6 wherein said means for coupling electrical energy to said cavity comprises a first conductor connected to one of said conductive foils and extending into said cavity and a second conductor located adjacent to the press seal containing said cavity.

9. An arc tube assembly as defined in claim 5 wherein means for coupling electrical energy to said cavity comprises an electrode extending into said cavity for external application of electrical energy.

10. An arc tube assembly as defined in claim 6 wherein said means for coupling electrical energy to said cavity comprises a portion of said conductive foil extending into said cavity and a second conductive foil extending into said cavity, said second conductive foil having an external lead attached thereto.

11. An arc tube assembly as defined in claim 6 further comprising a dispenser in said cavity for providing a material which enhances ultraviolet radiation when the dispenser is activated.

12. An arc tube assembly as defined in claim 6 further comprising a getter in said cavity for gettering at least one of the gases in the fill material when activated.

13. An arc tube assembly as defined in claim 6 wherein the conductive foil in at least one of the press seals has a sharp edge.

14. An arc tube assembly as defined in claim 9 wherein the electrode extending into the cavity has a sharp edge.

15. An arc discharge lamp comprising:

a light-transmissive arc tube containing a first fill material for supporting an arc discharge;

an outer envelope enclosing said arc tube;

means for coupling electrical energy to said arc tube;

a press seal defining a cavity therein, said cavity containing a second fill material for supporting emission of ultraviolet radiation; and means for coupling electrical energy to said cavity whereby ultraviolet radiation is emitted for assisting in initiation of an arc discharge within said arc tube.

* * * * *